US005716195A

United States Patent [19]

Thut

[11] Patent Number: 5,716,195

[45] Date of Patent: Feb. 10, 1998

[54] PUMPS FOR PUMPING MOLTEN METAL

[76] Inventor: Bruno H. Thut, 16755 Park Circle Dr., Chagrin Falls, Ohio 44023

[21] Appl. No.: 385,357

[22] Filed: Feb. 8, 1995

[51] Int. Cl.[6] ..... F04B 17/03

[52] U.S. Cl. ..... 417/53; 417/360; 417/473.14

[58] Field of Search ..... 417/360.53, 423.3, 417/423.15, 423.14, 724.1, 53, 360, 473.3, 424.1; 169/337; 222/594; 164/337

[56] References Cited

U.S. PATENT DOCUMENTS

| | | | |
|---|---|---|---|
| 2,464,936 | 3/1949 | McConaghy | 417/423.15 |
| 2,948,524 | 8/1960 | Sweeney | 415/88 |
| 3,255,702 | 6/1966 | Gehrm | 415/197 |
| 3,291,473 | 12/1966 | Sweeney | 415/88 |
| 3,719,436 | 3/1973 | McFarlin | 417/356 |
| 3,836,280 | 9/1974 | Koch | 415/175 |
| 4,052,199 | 10/1977 | Mangalick | 75/68 R |
| 4,169,584 | 10/1979 | Mangalick | 266/214 |
| 4,351,514 | 9/1982 | Koch | 266/217 |
| 4,786,230 | 11/1988 | Thut | 415/88 |
| 4,842,227 | 6/1989 | Harrington et al. | 248/56 |
| 4,898,367 | 2/1990 | Cooper | 266/216 |
| 4,930,986 | 6/1990 | Cooper | 416/189 |
| 4,940,384 | 7/1990 | Amra et al. | 415/121.2 |
| 4,954,167 | 9/1990 | Cooper | 75/708 |
| 5,092,821 | 3/1992 | Gilbert et al. | 464/152 |
| 5,143,357 | 9/1992 | Gilbert et al. | 266/235 |
| 5,177,035 | 1/1993 | Gee et al. | 501/82 |
| 5,203,681 | 4/1993 | Cooper | 417/424.1 |
| 5,308,045 | 5/1994 | Cooper | 266/235 |
| 5,310,412 | 5/1994 | Gilbert et al. | 75/571 |
| 5,330,328 | 7/1994 | Cooper | 417/424.1 |

FOREIGN PATENT DOCUMENTS 1264126 1/1990 Canada .

OTHER PUBLICATIONS

Pp. 330–340 (Chapter 11) from Physics, Worth Publishers, Inc. copyrighted 1982.

One Page advertisement for L Series molten metal pumps by Metaullics Systems Co., undated.

One page advertisement for M. Series Aluminum Molten Metal Pumps by Metaullics Systems Co., undated.

One page schematic drawing of a molten metal pump, source unknown, undated.

Six page brochure for "M Series" molten metal pumps by Metaullics Systems Co., copyright 1984.

Sixteen page operating instruction booklet for Metaullics Transfer Pumps for Molten Metal by the Carborumdum Company, copyright 1980.

Fourteen page operating instruction booklet for Metaullics Circulation Systems for Aluminum, Metaullics Systems Co., copyright 1984.

Two page advertisement describing exhibit, High Temperature Systems, Inc., 1985 TMS Annual Meeting Exhibition.

Five page article for Reduced Fuel Consumption through . . . Mechanized Molten Metal Circulation, The Carboradum Company, published by The Society of Die Casting Engineers, vol. 17, No. 5, pp. 22–31, Sep.–Oct. 1973.

One page advertising brochure, New L–Series Pumps, Metaullics Sytems Co., L.P., undated.

(List continued on next page.)

*Primary Examiner*—Timothy Thorpe
*Assistant Examiner*—Peter G. Korytnyk
*Attorney, Agent, or Firm*—Watts, Hoffmann, Fisher & Heinke Co LPA

[57] ABSTRACT

In a pump for pumping molten metal including a motor mounted to a motor mount, a base having an impeller chamber, a shaft connected to the motor at one end, an impeller connected to the other end of the shaft and rotatable in the impeller chamber, and support structure between the motor mount and the base comprising portions having lower ends fixed to the base, the improvement comprising: a quick release clamp carried by the motor mount for securing the motor mount to the support structure portions to form a pump assembly, the clamp having portions releasably clamping upper ends of the support structure portions, whereby a subassembly of the base and the support structure portions can be replaced as a unit when the clamp is opened.

16 Claims, 5 Drawing Sheets

OTHER PUBLICATIONS

Sixteen page operating instruction booklet for Metaullics De–Gas/De–Mag systems for Aluminum, Metaullics Systems Co., dated Apr. 1, 1985.

Sixteen page operating instruction booklet for Metaullics Transfer Pump Systems for Molten Metals, Metaullics Systems Co., copyright 1984.

Four page folder listing models of molten metal pumps by High Temperature Systems, Inc., published at least as early as Jun., 1990.

One page advertisement for replacement parts for M9000CSD Gas Injection Pump, High Temperature Systems, Inc., published at least as early as Oct., 1986.

One page advertisement for replacement parts for A5000C and A9000C Molten Metal Pump, High Temperature Systems, Inc., published at least as early as Sep., 1977.

One page advertisement for replacement parts for M50000CSD Gas Injection Pump, High Temperature Systems, Inc. published at least as early as Oct., 1986.

One page advertisement for replacement parts for M5000C Molten Metal Pump, High Temperature Systems, Inc. dated Jul., 1986.

Four page installation booklet for Mark II molten metal pumps, High Temperature Systems, Inc., published at least as early as Sep. 1973.

29 page operating instruction booklet, High Temperature Systems, Inc., undated.

PUMPS FOR PUMPING MOLTEN METAL

TECHNICAL FIELD

This invention relates to pumps for pumping molten metal, and more specifically to the field of repair and replacement of pump parts using factory assembled components.

BACKGROUND ART

A typical pump for pumping molten metal, such as aluminum, for example, includes a motor mounted to a motor mount, a base having an impeller chamber, a pump shaft connected to the motor at one end, an impeller connected to the other end of the pump shaft and rotatable in the impeller chamber, a shaft sleeve between the motor mount and the base surrounding the shaft, and support members between the motor mount and the base. The support members may be in the form of support posts and a tubular fisher that provides an outlet passage for the molten metal. The shaft sleeve, posts and riser are conventionally mounted at their corresponding lower ends to openings in the base, while their upper ends are mounted to sockets bolted to the motor mount. An example of such a pump construction is disclosed in U.S. Pat. No. 4,786,230 to Thut, issued Nov. 22, 1988.

The shaft sleeve, support posts, and riser are made of graphite in order to resist attack by the molten metal. Nevertheless, these parts require frequent replacement. The posts are usually replaced before their diameters have been reduced to about half their original diameters. The shaft sleeve and riser are usually replaced sooner when wall thickness is about half of the original thickness. How long the pump can be operated before the posts, shaft sleeve, and riser must be replaced varies due to the type of installation used and amount of daily maintenance performed. If the pump is operated for a duration that exceeds the life of these pump components, breakage and damage of the pump will result.

Pump repair by replacement of the support posts and risers is reported in a brochure by The Carborundum Co., "METAULLICS®—Transfer Pumps for Molten Metal," (1980). Replacement of the shaft sleeve may be performed in a similar manner. After the pump is removed from the furnace, the shaft and attached impeller are disconnected from the motor and removed from the base. The bolts connecting the posts and riser to sockets on the motor mount are then removed. This frees the posts and riser from the motor mount but the sockets are still cemented to their upper ends. Using a hack saw, the posts, shaft sleeve, and riser are cut flush with the top of the base at their lower ends, and cut flush with the sockets at their upper ends. Labor-intensive hammer and chisel work is then required to remove remaining material by hand from the sockets and from the holes of the base that receive these parts. Cement and remaining material must be carefully removed from the base holes because dimensions of the base holes must be maintained within certain tolerances if the base is to be reused.

The next step in the conventional pump repair process is to bolt the sockets back onto the motor mount. A new shaft sleeve, new posts, and a new riser are then dry fitted into the corresponding base holes. The motor mount having sockets affixed to it is then placed on top of the shaft sleeve, posts, and riser to check their alignment. For proper alignment the posts, shaft sleeve, and riser must be perpendicular to the base and the motor mount. An alignment fixture is often employed to ensure proper alignment of these parts. Next, the posts, the shaft sleeve, and the riser are cemented to the base. These parts are then connected to the motor mount such as by cementing them in the sockets of the motor mount. This cementing process is time consuming. It may take from 10 to 24 hours for the cement to completely dry while being heated at 120° C. to 150° C.

The conventional pump repair process presents problems to pump users. Usually, during the time it takes for the pump to be removed from the furnace and repaired, the furnace is not used. This down time of the furnace during pump repair is a costly problem. In view of this problem, multiple replacement pumps are sometimes used so that, when one of the pumps requires repair, it can be replaced by a different pump to avoid furnace down time. Acquiring and maintaining multiple replacement pumps results in costs attributable to repair and maintenance.

SUMMARY OF THE INVENTION

The present invention provides a structure and method for overcoming the repair and replacement problems heretofore associated with pumps for pumping molten metal. In particular, the invention makes it possible to quickly and expeditiously replace the shaft sleeve and support member, while avoiding significant furnace down time and the need to inventory entire replacement pumps.

In one embodiment, the pump structure of the invention comprises a motor mounted to a motor mount, a base having an impeller chamber, a shaft connected to the motor at one end, an impeller connected to the other end of the shaft and rotatable in the impeller chamber, a shaft sleeve between the motor mount and the base surrounding the shaft, and support member between the motor mount and the base, the shaft sleeve and support member having corresponding lower ends fixed to the base, and a quick release clamp carried by the motor mount for securing it to a shaft sleeve and support member to form a pump assembly, the clamp having portions releasably clamping corresponding upper end portions of the shaft sleeve and the support member, whereby a subassembly of the base, the shaft sleeve and the support member can be replaced as a unit when the clamp is opened.

In a preferred embodiment the support member is a tubular riser extending from the impeller chamber and forming an outlet passage for molten metal. The clamp is carried on an underside of the motor mount and consists of two clamp sections each configured to embrace adjacent ends of the shaft sleeve and the riser. Each of the clamp sections includes a flange having a horizontally extending portion mountable to the motor mount and a vertically extending portion mountable to the other clamp section. Bolts fasten the clamp sections to each other and to the motor mount. Each of the clamp sections has a symmetrical configuration in the form of half of a figure-eight configured to correspond to curved peripheral surfaces of the shaft sleeve and the riser. Each of the clamp sections includes a tongue on an inner surface thereof, and the shaft sleeve and the riser include a groove formed on the peripheral surface thereof corresponding to and mating with each tongue.

The shaft sleeve, support member and base constitute a preassembled subassembly package that can be purchased and replaced as a unit by the user. To repair the pump it is lifted from the furnace out of the molten metal and the quick release clamp is opened. The old, deteriorated shaft sleeve, riser and base are then removed from the motor mount and replaced by the preassembled package of the invention. The subassembly is then secured to the motor mount and clamped in place with the quick release clamp. The pump is then lowered into the molten metal and is ready for use.

The molten metal pump of the invention overcomes the problems associated with conventional pumps because its use greatly expedites the pump repair process. Use of the preassembled subassemblies advantageously avoids the need for multiple pumps, since it greatly reduces down time of the pump during repair. In other words, since the repair procedure of the present invention takes such little time, the pumping process can be suspending while the pump is being repaired. Down time of the pump is limited to the time required to install one of the subassemblies on the pump. The time required to repair a pump in accordance with the present method is substantially less than in conventional pump repair procedures. No labor intensive, time consuming hammer and chisel work is required by the user during pump repair to remove remaining material especially from the base of the pump. Moreover, the pump user is no longer required to conduct the time consuming, yet critical alignment of a shaft sleeve and support structure to a base, involving cementing these parts to the base, and drying for many hours. Instead, the user simply repairs the pump by conveniently installing one of the preassembled subassemblies in which the shaft sleeve and support structure have already been prealigned to be substantially perpendicular with the base. Thus, use of the present pump subassembly is cost effective since it significantly reduces down time of the pump and eliminates the need for multiple replacement pumps.

In another embodiment the invention provides a method of operating and maintaining a molten metal pump of the type described including a base having an impeller chamber, a motor mount, and a shaft sleeve and support members attached to the base. The preferred method comprises the steps of providing a replaceable subassembly including a base and attached shaft sleeve and a support member, operating the pump until at least one of the shaft sleeve, support members and base requires replacement, removing the base, shaft sleeve and support members as a unit from the pump, and installing the replaceable subassembly on the pump.

Other embodiments of the invention are contemplated to provide particular features and structural variants of the basic elements. The specific embodiments referred to as well as possible variations and the various features and advantages of the invention will become better understood from the detailed description that follows, when considered in connection with the accompanying drawings.

DETAILED DESCRIPTION OF PREFERRED EMBODIMENTS

Figure 1:
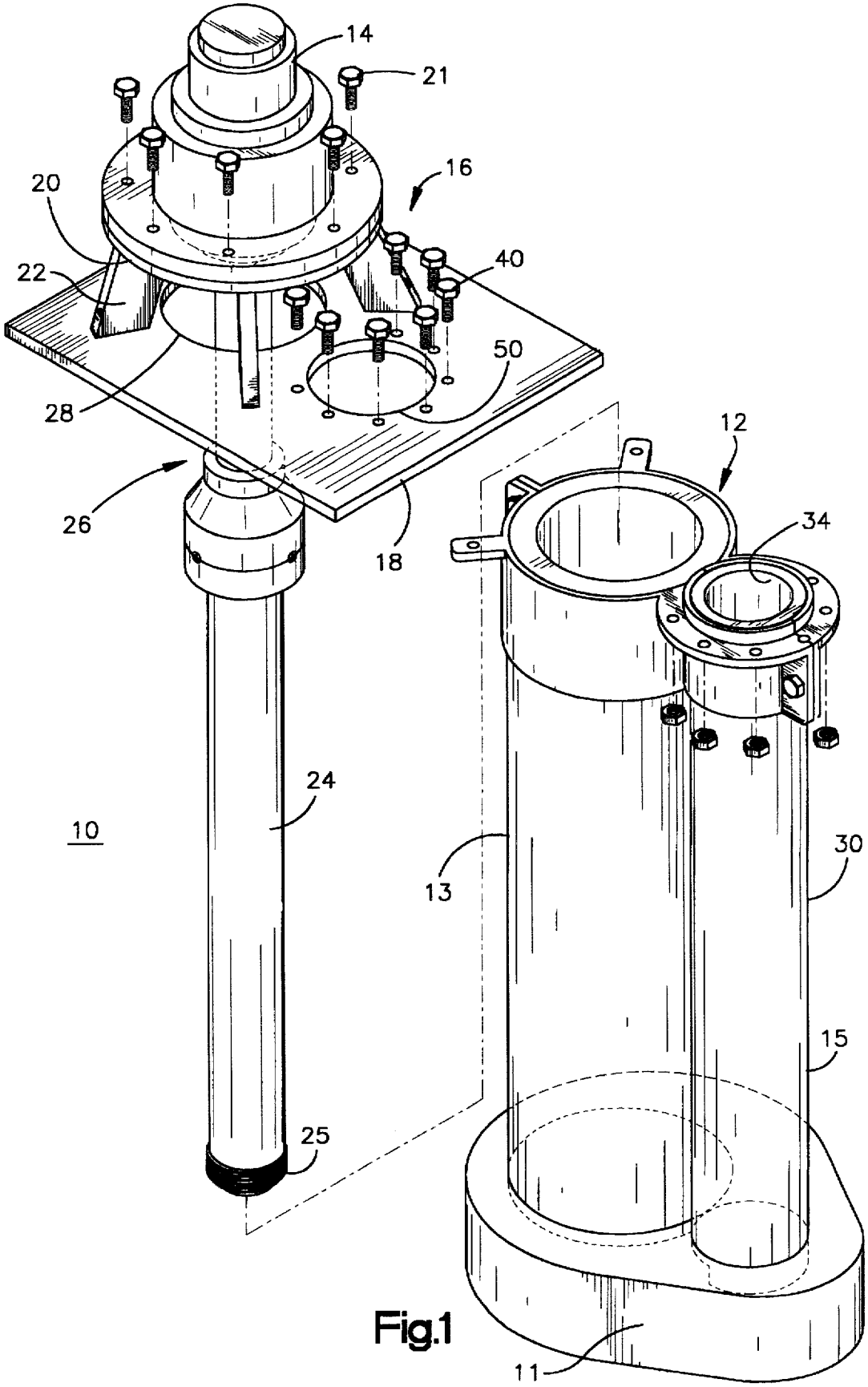
FIG. 1 is an exploded perspective view showing a pump constructed in accordance with the invention.
Figure 2:
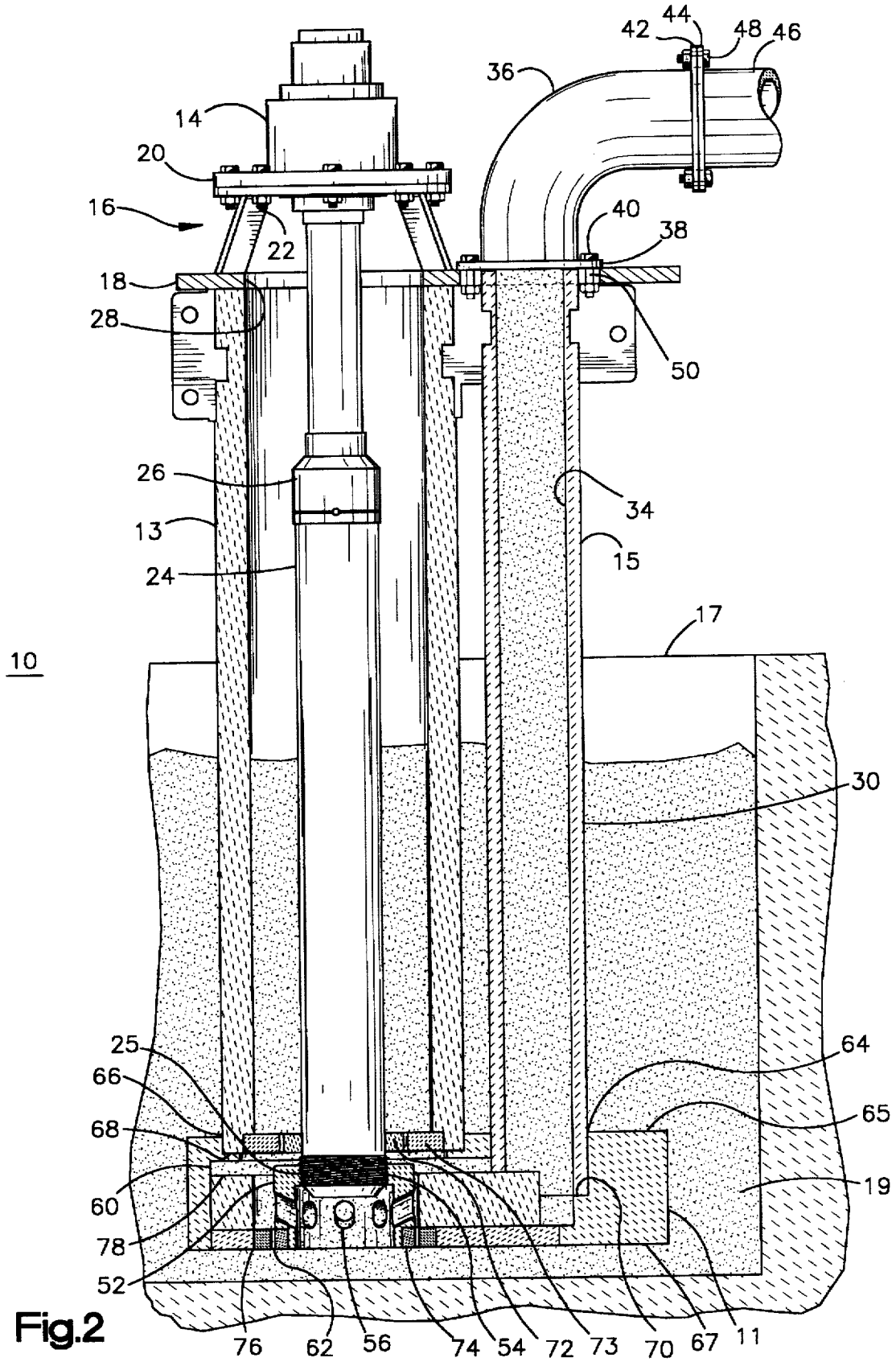
FIG. 2 is a vertical cross-sectional view of the invention shown in FIG. 1.
Figure 2A:
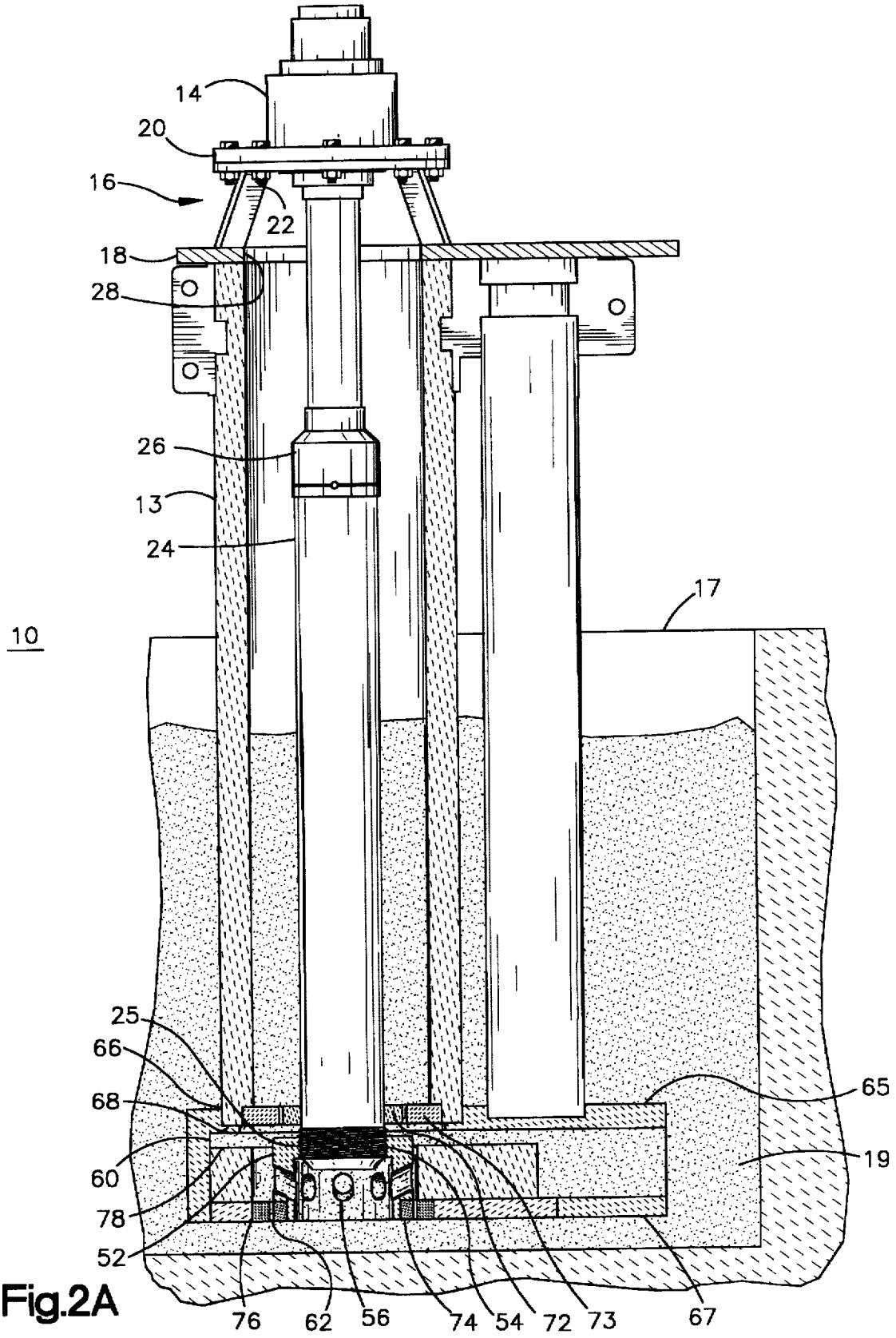
FIG. 2A is a vertical cross-sectional view showing a pump embodying the present invention.

Referring now to the drawings and to FIGS. 1 and 2 in particular, the illustrated pump is generally designated by reference numeral 10 and is shown as a so-called bottom feed transfer pump that includes a motor 14 mounted to a motor mount 16. A base 11 has an impeller chamber 60 formed therein. A shaft 24 is connected to the motor 14 at one end. An impeller 52 is connected to the other end of the shaft 24 and is rotatable in the impeller chamber 60. A shaft sleeve 13 is disposed between the motor mount 16 and the base 11 and surrounds the shaft 24. A support member 30 is disposed between the motor mount 16 and the base 11. The shaft sleeve 13 and the support member 30 have corresponding lower ends fixed to the base 11. A quick release clamp 152 is carried by the motor mount 16 for securing it to the shaft sleeve 13 and the support member 30 to form a pump assembly. The clamp 152 has sections 154, 156 releasably clamping corresponding upper end portions at the shaft sleeve 13 and the support member 30. A subassembly of the base 11, shaft sleeve 13 and support member 30 preferably constitute a pre-assembled unit available from the pump manufacturer.

The motor mount 16 comprises a flat mounting plate 18 including a motor support portion 20 supported by legs 22. A hanger (not shown) may be attached to the motor mount 16 for hoisting the pump 10 into and out of the furnace 17. The motor 14 is an air motor or the like, and is directly mounted onto the motor support portion 20 using fasteners such as bolts 21. Any construction of the motor mount 16 may be used as known to those skilled in the art.

A shaft 24 is connected to the motor 14 by a coupling assembly 26 which may be constructed in the manner shown in U.S. patent application Ser. No. 08/336,987 to Thut, filed Nov. 10, 1994, entitled "Shaft Coupling for a Molten Metal Pump", the disclosure of which is incorporated herein by reference. The motor mount 16 shown in FIGS. 1 and 2 includes an opening in the motor support portion 20 (not shown) and an opening 28 in the mounting plate 18 which permit connecting the motor 14 to the shaft 24 by the coupling assembly 26.

An impeller 52 is connected at the other end of the shaft 24 in the well known manner, such as by engagement of exterior shaft threads 25 formed on the shaft 24 with corresponding interior threads 54 of the impeller 52. The impeller 52 includes a plurality of molten metal passageways 56. The invention is not limited to any particular impeller construction in this or in the following embodiments.

The pump 10 shown in FIG. 2 includes the base 11 having an impeller chamber 60 with a molten metal inlet opening 62 and a molten metal outlet opening 64. A support member 30 is preferably a tubular riser 15 extending from the impeller chamber 60 and forming a passageway 34 for the outlet of molten metal 19. However, any suitable support member 30, including support posts, may be used instead if the pump 10 is a discharge pump or the like. If the support member 30 consists of the tubular riser 15, an opening 50 is provided in the mounting plate 18 permitting passage of molten metal 19 between the riser 15 and elbow 36. The elbow 36 is connected to the mounting plate 18, and includes a flange 38 at one end which is connected to the motor mount 16 by fasteners, such as bolts 40. The elbow 36 also includes a flange 42 at the other end which is connected to a flange 44 of an exit pipe 46 by fasteners, such as bolts 48. Gaskets are employed to seal the riser 15, the elbow 36, and the exit tube 46 connections in the well known manner. Although the elbow 36 is shown, any other suitable connection between the exit pipe 46 and the riser 15 may be used.

The shaft sleeve 13 surrounds and contains the shaft 24. The shaft sleeve 13 and the riser 15 extend between the mounting plate 18 and the base 11 and are connected to the base 11 at corresponding lower portions. The shaft sleeve 13 and the riser 15 are prealigned to extend substantially perpendicular to the base 11. The phrase extending substantially perpendicular to the base 11 (in this and in the following embodiments) means that the shaft sleeve 13 and the riser 15 extend substantially perpendicular to the top surface 65 and the bottom surface 67 of the base 11.

The base 11 contains an opening 66 that receives the shaft sleeve 13. The outlet opening 64 of the impeller chamber 60 receives the riser 15. The base 11 includes a shoulder 68 near the opening 66 which supports the shaft sleeve 13. Near the outlet opening 64 of the base chamber 60 is a shoulder 70 which supports the riser 15. The shaft sleeve 13 and the riser 15 are attached to the base 11 by being positioned against the shoulders 68, 70 and cemented in place, preferably using H.T.S. cement by High Temperature Systems, Inc. The base 11 optionally includes a spiral volute member 78, which may result in better molten metal flow properties as is known in the art.

As best shown in FIG. 2, the support member 30 preferably takes the form of the single tubular riser 15 and is preferably located proximate to the shaft sleeve 13, i.e., the riser 15 is nearly contiguous with the shaft sleeve 13. No support structure other than the shaft sleeve 13 and a single support member 30 is required. The significance of using support structure consisting essentially of a single support member 30 and of providing the support member 30 proximate to the shaft sleeve 13 is to facilitate clamping of the shaft sleeve 13 and the support member 30 with the quick release clamp 152 which is described in detail below. In addition, by providing the support structure 30 at a location proximate to the shaft sleeve 13 the diameter of the base 11 may be decreased.

A shaft bearing 72 is connected to a lower end of the shaft 24. This shaft bearing 72 is surrounded by a shaft sleeve bearing 73 which is supported by the shaft sleeve 13. The shaft bearing 72 and shaft sleeve bearing 73 protect the shaft 24 from striking the shaft sleeve 13.

The impeller 52 preferably has a bearing 74 disposed at one end thereof near the inlet opening 62 of the base 11. Circumscribing the inlet opening 62 of the base chamber 60 is an annular inlet bearing 76. The inlet bearing 76 surrounds the impeller bearing 74. The bearings 74, 76 protect the impeller 52 from impact with the base 11.

In operation, the transfer pump 10 is lowered into the molten metal 19 and secured in place. The motor 14 is activated to rotate the shaft 24 via the coupling assembly 26. Rotation of the shaft 24 rotates the impeller 52 in the molten metal 19. Centrifugal forces caused by rotation of the impeller 52 in the impeller chamber 60 causes molten metal 19 to enter the bottom of the pump 10 through the inlet opening 62 and into the impeller chamber 60. Molten metal 19 is directed through the impeller passageways 56 upon rotation of the impeller 52. The molten metal 19 is then directed from the optional volute member 78 toward the base outlet opening 64, through the passageway 34 of the riser 15. The molten metal 19 is transferred through the elbow 36 and the exit pipe 46, by which it is removed from the furnace 17.

Figure 3:
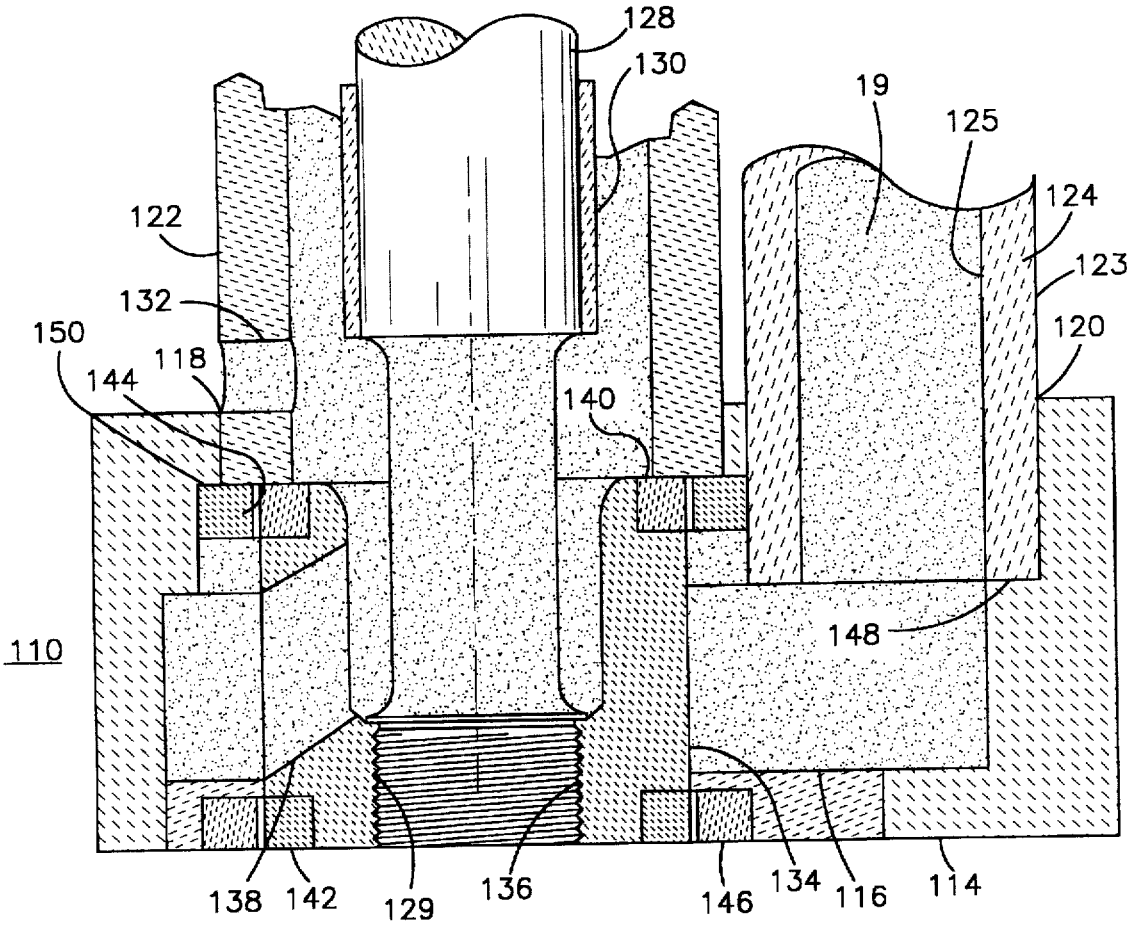
FIG. 3 is an enlarged cross-sectional view showing a portion of a different type of pump.

Referring now to the drawings and to FIG. 3 in particular, the illustrated pump is generally designated by reference numeral 110. The pump 110 is a top feed transfer pump which is a variation of the pump 10 previously described, where like reference numerals designate like parts, as modified in the manner set forth below. The subassembly includes a base 114 having an impeller chamber 116 with a molten metal inlet opening 118 and a molten metal outlet opening 120.

A shaft sleeve 122 and a support member 123 in the form of a tubular riser 124 are attached to the base 114 at corresponding lower portions. The riser 124 extends from the impeller chamber 116 and has a passageway 125 through it for passage of the molten metal 19 from the pump 110. The shaft sleeve 122 and the riser 124 extend between the mounting plate 18 and the base 114, and are prealigned to extend substantially perpendicular to the base 114. The base inlet opening 118 receives the shaft sleeve 122. The base outlet opening 120 receives the riser 124. A shoulder 148 is formed at the base outlet opening 120 and supports the riser 124. The riser 124 is positioned on the shoulder 148 in the base outlet opening 120, aligned so as to be substantially perpendicular with the base 114, and cemented in place.

As best shown in FIG. 3, the support member 123 preferably takes the form of the single tubular riser 124 and is located preferably proximate to the shaft sleeve 122 so as to be nearly contiguous with the shaft sleeve 122. No support structure other than the shaft sleeve 122 and a single support member 123 is required. The significance of using support structure consisting essentially of a single support member 123 and of providing the support member 123 proximate to the shaft sleeve 122 is to facilitate clamping of the shaft sleeve 122 and the support member 123 with the quick release clamp 152 which is described in detail below. In addition, by providing the support structure 123 at a location proximate to the shaft sleeve 122 the diameter of the base 114 may be decreased.

A shaft 128 is contained and surrounded by the shaft sleeve 122. The shaft 128 preferably has a refractory sleeve 130 formed around it. This refractory sleeve 130 protects the shaft 128 from oxidation and erosion by the molten metal. The shaft sleeve 122 contains multiple inlet openings 132 adjacent the base 114.

The impeller 134 is attached to one end portion of the shaft 128 in the well known manner, such as by engagement of exterior threads 129 formed on the shaft 128 with corresponding interior threads 136 formed in the impeller 134. The impeller 134 has a plurality of passageways 138 for molten metal. The impeller 134 includes a first annular bearing 140 at an upper portion thereof and a second annular bearing 142 at a lower portion thereof.

The first bearing 140 is surrounded by an annular bearing 144 connected to the base 114. The bearing 144 is connected to a lip portion 150 of the base 114. The bearing 144 thus acts as a shoulder and supports the shaft sleeve 122. The shaft sleeve 122 is positioned on the bearing 144, aligned so as to be substantially perpendicular with the base 114, and cemented in place. The second impeller bearing 142 is circumscribed by an annular bearing 146 disposed at a lower portion of the base 114. The bearings 140, 142, 144, and 146 protect the impeller 134 from sting the base 114.

In operation, the transfer pump 110 is lowered into the molten metal 19 and the motor 14 is activated to rotate the shaft 128 via the coupling assembly 26. Rotation of the shaft 128 rotates the impeller 134 and centrifugal forces cause molten metal 19 to be fed into the top of the pump 110. The molten metal 19 enters the multiple inlet openings 132 of the shaft sleeve 122, passes through the base inlet opening 118, and then passes into the impeller chamber 116. Although not shown here, the impeller chamber 116 optionally contains a spiral volute member. The molten metal 19 is then directed by the impeller passageways 138 to the base outlet opening 120, where it passes through the passageway 125 of the riser 124 and is transferred from the pump 110.

Figure 4:
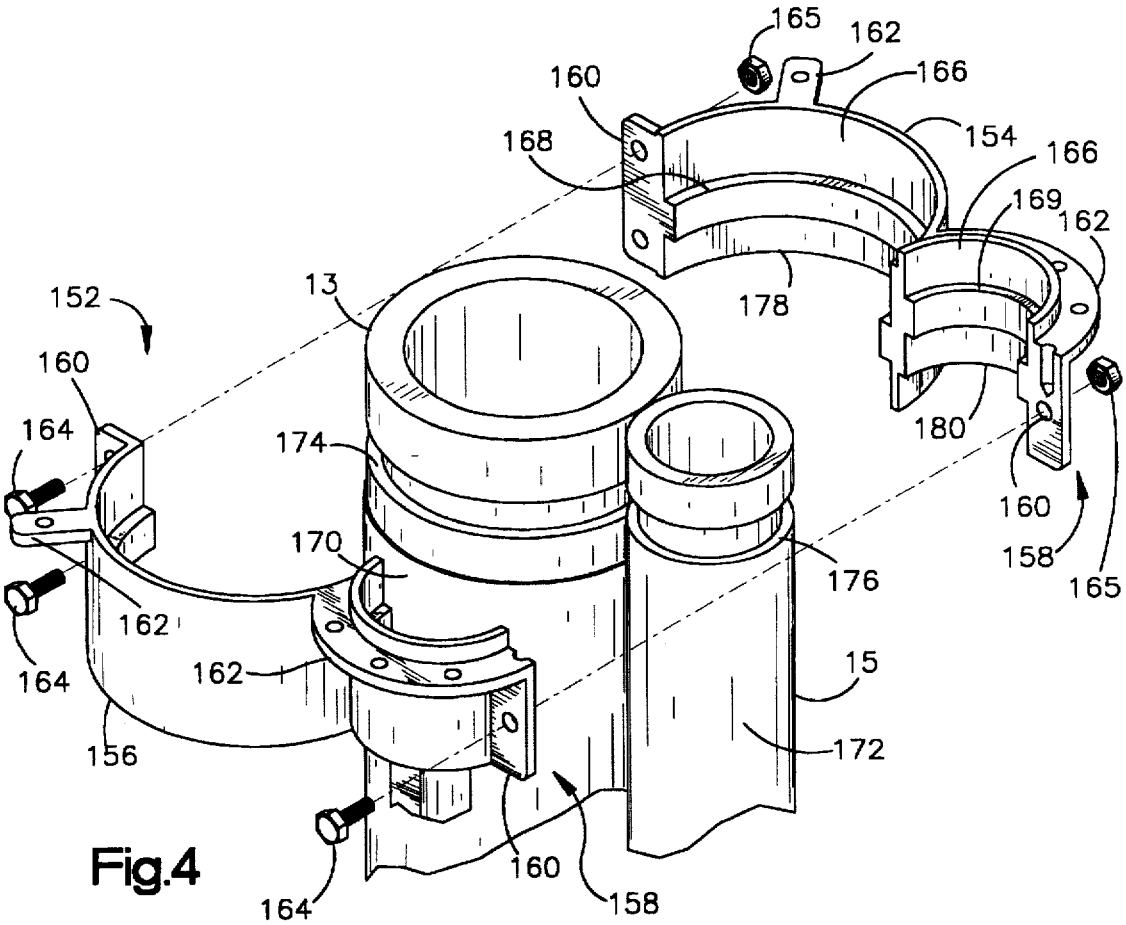
FIG. 4 is an exploded perspective view showing an upper portion of the pump embodying the present invention.
Figure 5:
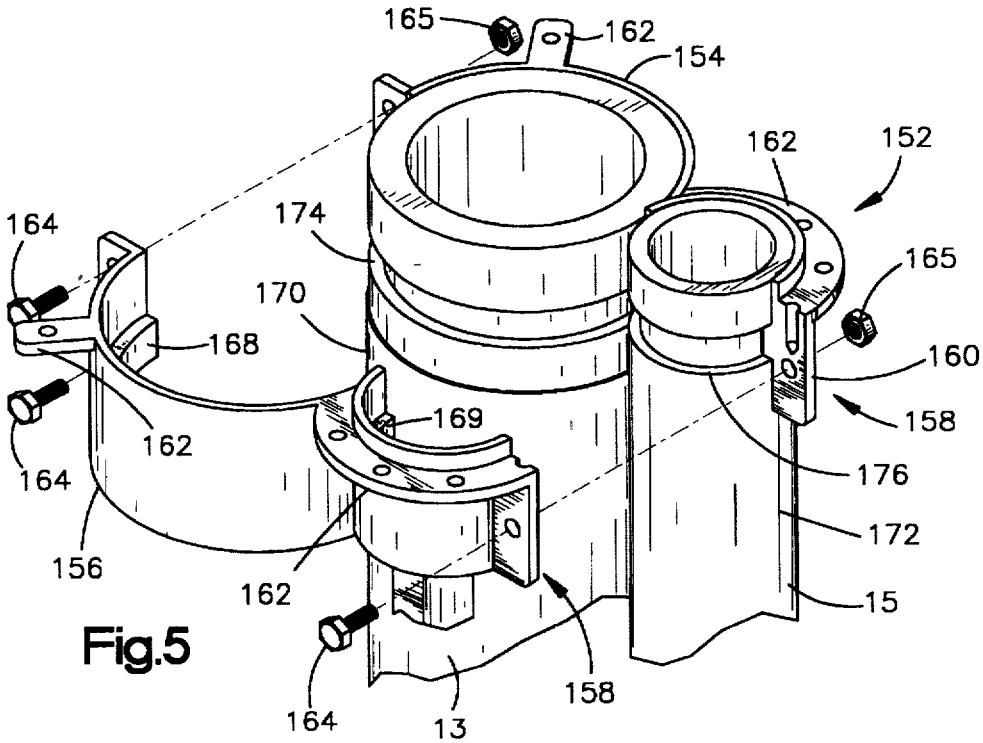
FIG. 5 is an exploded perspective view similar to FIG. 4 showing portions of the pump partially assembled.

Referring now to FIGS. 4 and 5, the quick release clamp 152 is carried on an underside of the motor mount 16. The clamp 152 has opposing symmetrical first and second sections 154, 156 each having a configuration in the form of half of a figure-eight corresponding to curved exterior peripheral surfaces 170, 172 of the shaft sleeve 13 and the riser 15. The clamp 152 may include a hinge or the like (not shown), connecting the sections 154, 156 together at one end. The sections 154, 156 are wrapped around or embrace adjacent ends of the shaft sleeve 13 and the support member 30.

Each of the clamp sections 154, 156 has a flange portion 158 mountable to the motor mount 16 and to the other clamp section. Each of the flange portions 158 of the first and second clamp sections 154, 156 has a vertically extending portion 160 mountable to a corresponding vertically extending portion 160 on the other section. Each of the flange portions 158 also has a horizontally extending portion 162 mountable to the mounting plate 18. Fasteners, such as bolts 164, connect the first and second clamp sections 154, 156 to each other and to the motor mount 16 (although for clarity bolts 164 are only shown connecting the clamp sections 154, 156). Nuts 165 may be used to secure the bolts 164 in place. Fastening of the first and second clamp sections 154, 156 is not limited to the use of bolts and nuts, and any other suitable fasteners may be used for this purpose. Using the bolts 164 alone may be sufficient to connect the first and second clamp sections 154, 156 together.

To increase the effectiveness of the clamp 152, the inner surfaces 166 of the first and second clamp sections 154, 156 preferably include tongues 168, 169. The tongue 168 is on a portion 178 of the clamp sections 154, 156 that corresponds to the shaft sleeve 13, and the tongue 169 is on a portion 180 of the clamp section 154, 156 that corresponds to the riser 15. The exterior surface 170 of the shaft sleeve 13 and the exterior surface 172 of the riser 15 include grooves 174, 176, which respectively correspond to and are mated with the tongues 168 and 169. This tongue-and-groove connection prevents movement of the shaft sleeve 13 and the riser 15 relative to the motor mount 16.

In a preferred form of the quick release clamp 152, the position of the groove 174 on the shaft sleeve 13 is vertically staggered with respect to the position of the groove 176 on the riser 15. For example, the groove 174 on the shaft sleeve 13 is lower than the groove 176 on the riser 15. Accordingly, the tongue 168 is lower than the tongue 169. This staggered relationship between the tongues 168, 169 and their respective grooves 174, 176 further reduces the chance of slippage of the clamp 152 on the shaft sleeve 13 and the riser 15.

In the present method of pump repair, the subassembly of the pump 10, 110 is preferably prepared in advance by a pump manufacturer who then ships the preassembled subassemblies to the user. As described above, each subassembly has the shaft sleeve 13, 122 and the support member 15, 122 cemented and prealigned to extend substantially perpendicular to the base 11, 114. This prealignment is critical for proper installation of the pump. If the shaft sleeve 13, 122 and riser 15, 124 are not aligned substantially perpendicular to the base 11, 114, connection of these parts to the motor mount 16 is difficult or impossible.

The quick release clamp 152 of the invention is preferably used during pump repair, as opposed to conventional motor mount sockets and the like. The clamp 152 assists in the removal of the old pump components and installation of the present subassemblies. When modifying an existing pump of the type described above, for example, the sockets that are bolted to the motor mount are preferably replaced by the clamp 152 and are no longer required. Thus, it is not necessary to cement the support posts and the support structure to any motor mount sockets.

The pump (e.g., transfer pump 10) is operated until at least one of the members of the old pump components, i.e., the shaft sleeve 13 and the riser 15, have deteriorated to the point that they must be replaced. Now, the preassembled subassembly is removed from storage. The pump 10 is hoisted from the furnace 17 in the conventional manner. One of the clamp sections, e.g., the second clamp section 156 (FIG. 4), is removed from the mounting plate 18 by removing the corresponding bolts 164 and nuts 165 from the horizontal and vertical flange portions 160, 162 of the second clamp section 156. Alternatively, the second clamp section 156 is unbolted from the first clamp section 154 and the mounting plate 18, and pivoted about a hinge connecting it to the first clamp section 154, rather than removed. The horizontal portion 162 of the other clamp section (e.g., the first clamp section 154) preferably remains mounted to the mounting plate 18. If desired, however, the first clamp section 154 may be completely removed from the mounting plate 18. The old deteriorated pump components are removed from the pump 10 and replaced with the preassembled subassembly.

It is assumed that at this point the first clamp section 154 remains mounted to the mounting plate 18. The shaft sleeve 13 and the riser 15 of the subassembly are moved below the mounting plate 18, so that the tongue 168 of the first clamp section 154 engages and is mated to corresponding groove 174 on the exterior surface of the shaft sleeve 13, and its tongue 169 engages and is mated to the groove 176 on the exterior surface of the riser 15. The second clamp section 156 is now wrapped around or embraces the shaft sleeve 13 and the riser 15 so that its tongues 168, 169 are engaged and mated with the respective grooves 174, 176 in the shaft sleeve 13 and the riser 15, forming a figure eight as seen in top plan view. The vertical flange portions 160 of the first and second clamp sections 154, 156 are abutted against each other and bolted together. The horizontal portion 162 of the second clamp section 156 is now bolted to the mounting plate 18, thus completing the subassembly installation procedure.

What is claimed is:

1. In a method of operating and maintaining a pump for pumping molten metal of the type including a base having an impeller chamber, a motor mount, and a shaft sleeve and a support member attached to said base, the improvement comprising the steps of clamping the shaft sleeve and the support member together, securing the shaft sleeve and the support member to the motor mount, operating the pump until at least one of the shaft sleeve, support member and base requires replacement, removing the base, shaft sleeve and support member as a unit from the pump, and installing a replaceable subassembly including a base and attached shaft sleeve and a support member on the pump.

2. In a method of operating and maintaining a pump for pumping molten metal of the type including a base having an impeller chamber, a motor mount, and support structure attached to the base, the improvement comprising the steps of clamping portions of the support structure together, securing the clamped support structure portions to the motor mount, operating the pump until at least one of the support structure portions and base requires replacement, removing the base and support structure portions as a unit from the pump, and installing a replaceable subassembly including a base and attached support structure portions on the pump.

3. In a pump for pumping molten metal including a motor mounted to a motor mount, a base having an impeller chamber, a shaft connected to the motor at one end, an impeller connected to the other end of the shaft and rotatable in the impeller chamber, a shaft sleeve located between the motor mount and the base surrounding the shaft, and a support member located between the motor mount and the base, said shaft sleeve and the support member having lower ends fixed to said base, the improvement comprising:

a quick release clamp carried by said motor mount for securing said motor mount to a shaft sleeve and a support member to form a pump assembly, said clamp having portions releasably clamping upper end portions of said shaft sleeve and said support member, whereby a subassembly of said base, said shaft sleeve and said support member can be replaced as a unit when said clamp is opened.

4. The improvement of claim 3 wherein said support member is a tubular riser extending from said impeller chamber and forming an outlet passage for molten metal.

5. The improvement of claim 3 wherein said clamp is carried on an underside of the motor mount and consists of two clamp sections each configured to embrace adjacent ends of said shaft sleeve and said support member.

6. The improvement of claim 5 wherein each of the clamp sections includes a flange having a horizontally extending portion mountable to the motor mount and a vertically extending portion mountable to the other clamp section.

7. The improvement of claim 6 further comprising fasteners for connecting the clamp sections to each other and to the motor mount.

8. The improvement of claim 5 wherein each of the clamp sections has a symmetrical configuration in the general form of half of a figure-eight corresponding to curved exterior surfaces of said shaft sleeve and said support member.

9. The improvement of claim 5 wherein each of the clamp sections includes a tongue on an inner surface thereof, and the shaft sleeve and the riser include a groove formed on a peripheral surface thereof corresponding to and mating with each said tongue.

10. A pump for pumping molten metal comprising a motor mounted to a motor mount, a base having an impeller chamber, a shaft connected to the motor at one end, an impeller connected to the other end of the shaft and rotatable in the impeller chamber, and support structure located between the motor mount and the base consisting essentially of a shaft sleeve surrounding the shaft and a single support member located proximate to the shaft sleeve, further comprising a quick release clamp carried by said motor mount for securing said motor mount to said shaft sleeve and support member to form a pump assembly, said clamp having portions releasably clamping upper end portions of said shaft sleeve and support member, whereby a subassembly of said base, shaft sleeve and support member can be replaced as a unit when said clamp is opened.

11. A subassembly for repairing a pump for pumping molten metal of the type including a base having an impeller chamber, a motor mount, and a shaft sleeve and a support member attached to said base, the subassembly comprising:

a base with an impeller chamber, and a shaft sleeve and support member fixed at their lower ends to said base, and a quick release clamp adapted to be carried by said motor mount for securing said shaft sleeve and support member of the subassembly to form a pump assembly, said clamp having portions adapted to releasably clamp upper end portions of said shaft sleeve and support member of the subassembly, whereby the subassembly replaces said base, said shaft sleeve and said support member when the pump is in need of repair.

12. In a pump for pumping molten metal including a motor fastened to a motor mount, a base having an impeller chamber, a shaft connected to the motor at one end, an impeller connected to the other end of the shaft and rotatable in the impeller chamber, and support structure located between the motor mount and the base, said support structure comprising portions having lower ends fixed to the base, the improvement comprising:

a quick release clamp carried by the motor mount for securing the motor mount to said support structure to form a pump assembly, said clamp having portions releasably clamping upper ends of said support structure portions, whereby a subassembly of the base and said support structure portions can be replaced as a unit when said clamp is opened.

13. The improvement of claim 12 wherein one of said support structure portions secured by said clamp is a support post.

14. The improvement of claim 12 wherein one of said support structure portions secured by said clamp is a shaft sleeve surrounding the shaft between the motor mount and the base.

15. The improvement of claim 12 wherein one of said support structure portions secured by said clamp is a tubular riser extending from said impeller chamber and forming an outlet passage for molten metal.

16. The improvement of claim 12 wherein said clamp is carried on an underside of the motor mount and consists of two clamp sections each configured to embrace adjacent ends of the support structure portions.

* * * * *